US007597311B2

(12) United States Patent
Kawata et al.

(10) Patent No.: US 7,597,311 B2
(45) Date of Patent: Oct. 6, 2009

(54) SHEET PROCESSING APPARATUS AND IMAGE FORMING APPARATUS PROVIDED THEREWITH AND SHEET PROCESSING METHOD

(75) Inventors: Wataru Kawata, Kashiwa (JP); Hitoshi Kato, Toride (JP); Keiko Fujita, Kashiwa (JP); Youichi Chikugo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 11/557,313

(22) Filed: Nov. 7, 2006

(65) Prior Publication Data

US 2007/0126165 A1 Jun. 7, 2007

(30) Foreign Application Priority Data

Nov. 11, 2005 (JP) ..... 2005-326887
Oct. 27, 2006 (JP) ..... 2006-292011

(51) Int. Cl.
*B65H 37/04* (2006.01)

(52) U.S. Cl. ..... 270/37; 270/4; 270/12; 270/20.1; 270/32; 270/45; 270/48; 270/51; 270/58.07; 270/58.08

(58) Field of Classification Search ..... 270/4, 270/12, 20.1, 32, 37, 45, 48, 49, 50, 51, 58.07, 270/58.08; 493/399, 400, 416, 424, 434, 493/435, 440, 445, 446
See application file for complete search history.

(56) References Cited

U.S. PATENT DOCUMENTS 5,911,414 A 6/1999 Kato et al. ..... 270/58.07
6,145,826 A 11/2000 Kawata ..... 270/58.28
6,237,910 B1 5/2001 Kawata ..... 271/213
6,241,234 B1 6/2001 Saitoh et al. ..... 270/58.12
6,264,189 B1 7/2001 Kawata ..... 271/176
6,276,677 B1 8/2001 Hommochi et al.
6,505,829 B2 1/2003 Kawata ..... 271/208
6,804,473 B2 10/2004 Nakamura et al. ..... 399/16
6,823,154 B2 11/2004 Koga et al. ..... 399/110
6,908,078 B2 6/2005 Suzuki et al. ..... 270/15
6,929,256 B2 8/2005 Kawatsu et al. ..... 270/37
6,976,672 B2 12/2005 Kawata ..... 271/9.11

(Continued)

FOREIGN PATENT DOCUMENTS

JP 11-193175 7/1999

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A sheet bundle stored in a sheet storage portion is pushed from a predetermined folded position with a first pushing plate, and the sheet bundle is normally conveyed along with the first pushing plate and plunged into a nip between first folding rollers to make a fold. The first folding rollers are reversely rotated while the first pushing plate is retreated, and the sheet bundle with the fold is reversely conveyed and returned to the sheet storage portion. Then, a second pushing plate pushes the sheet bundle, conveyed through a U-shape conveyance path, from a backside of the fold to reversely fold the sheet bundle, and the sheet bundle is completely folded. Therefore, the sheet bundle having good appearance can be realized in good bundle folding processing.

14 Claims, 13 Drawing Sheets

U.S. PATENT DOCUMENTS

| | | | | |
|---|---|---|---|---|
| 6,997,449 | B2 | 2/2006 | Obuchi et al. | 270/32 |
| 6,997,450 | B2 * | 2/2006 | Trovinger | 270/52.26 |
| 7,011,306 | B2 | 3/2006 | Kato et al. | 271/256 |
| 7,050,751 | B2 | 5/2006 | Watanabe et al. | 399/391 |
| 7,080,830 | B2 | 7/2006 | Suzuki et al. | 270/58.08 |
| 2005/0077671 | A1 * | 4/2005 | Trovinger | 270/52.26 |

FOREIGN PATENT DOCUMENTS

| | | |
|---|---|---|
| JP | 2003-335455 | 11/2003 |
| JP | 2004-106976 | 4/2004 |

* cited by examiner

SHEET PROCESSING APPARATUS AND IMAGE FORMING APPARATUS PROVIDED THEREWITH AND SHEET PROCESSING METHOD

BACKGROUND OF THE INVENTION

1. Field of the Invention

The present invention relates to an image forming apparatus such as a copying machine, a facsimile machine, a printer, and a multi function mechanism. The invention also relates to a sheet processing apparatus which performs processing such as alignment, binding, and center-folding to image-formed sheets which are discharged from the image forming apparatus. The invention also relates to a sheet processing method.

2. Description of the Related Art

The image forming apparatus such as the copying machine is provided with a sheet post-processing apparatus which stacks plural image-formed sheets to perform saddle stitch or the like. The sheet bundle which is center-folded at a binding position is discharged and stacked on a discharge tray with a folded portion in the lead. When the folded sheet bundle has a thick, or when the sheet has strong stiffness, it is difficult that the sheet bundle is completely folded, and sometimes the sheet bundle becomes poor-looking because both ends are opened after the sheet bundle is folded. When the sheet bundle is loosely folded to easily open both the ends, the subsequent sheet bundle plunges into the already stacked sheet bundle in stacking the plural sheet bundles on top of another on a discharge tray. When the sheet bundles are stacked on top of another while swollen, the sheet bundles easily collapse.

In order to eliminate the defect, for example, Japanese Patent Application Laid-Open No. 11-193175 discloses a sheet bundle folding apparatus and a sheet processing apparatus. In this case, when the folded portion of the sheet bundle is delivered toward a nip between a pair of folding rollers, a pushing member plunges the folded portion of the sheet bundle between the folding rollers while being followed by motion of the sheet bundle. Therefore, the sheet bundle is completely folded by correctly and securely pushing the folded portion of the sheet bundle with the pushing member.

However, in the sheet bundle folding apparatus and sheet processing apparatus disclosed in Japanese Patent Application Laid-Open No. 11-193175, there are problems to be solved.

One of the problems is that, in the case where the folding processing is performed to the sheet bundle, the fold becomes looser in the sheet located close to the outside of the folded sheet bundle. This is attributed to the fact that a folded radius becomes larger in the sheet located close to the outside due to a thickness of the sheet bundle.

Another problem is that, during an action in a staple mode selected by a user, sometimes breakdown or wrinkle is generated in a wire-stitched portion when the sheet bundle is center-folded at the wire-stitched portion with the sheet bundle folding apparatus disclosed in Japanese Patent Application Laid-Open No. 11-193175 after stapling process is previously performed at the predetermined position where the sheet bundle is center-folded. This is because a cover sheet is broken from the wire-stitched portion to generate the wrinkle by a difference between frictional resistance which the cover sheet receives from a roller surface and frictional resistance generated by rubbing the sheets with one another inside the sheet bundle when the sheet bundle is conveyed while nipped between the rollers.

Still another problem is a defect which is generated by bringing the pushing member close to the folding roller to prevent the breakdown and wrinkle as much as possible. In the configuration disclosed in Japanese Patent Application Laid-Open No. 11-193175, when the sheet bundle is nipped between the folding rollers, the pushing member which is stopped just before the sheet bundle rubs the inside of the sheet bundle to generate a scratch and a trace.

In view of the foregoing, an object of the invention is to provide a sheet processing apparatus which obtains the folded sheet bundle having the good appearance and excellent stacking property by performing the folding processing to the sheet bundle twice in an opposite direction, and an image forming apparatus provided with the sheet processing apparatus.

SUMMARY OF THE INVENTION

In order to achieve the above object, a sheet processing apparatus according to the present invention includes a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position.

An image forming apparatus according to the present invention includes an image forming portion which forms an image in a sheet; and a sheet processing apparatus having the above configuration, which performs processing to the sheet in which the image is formed by the image forming portion.

According to the sheet processing apparatus of the invention, the first folding unit tentatively center-folds the sheets to make a fold and the second folding unit folds the sheets in the opposite direction from the backside of the fold again, which enables the sheet bundle becomes good-looking in the good sheet bundle folding processing.

Furthermore, in the sheet processing apparatus of the invention, the first folding roller folds the sheets including the first pushing member. Therefore, even if the saddle stitch is performed to the sheet bundle to which the staple processing is already performed, the sheets cannot be broken in the staple portion, and rubbing is not generated inside the saddle stitch bundle.

According to the image forming apparatus of the invention, the sheet bundles never collapse because the sheet bundles completely folded by the sheet processing apparatus are orderly stacked and stored in the discharge tray. And productivity can be improved as a whole because the image-formed sheet is efficiently delivered to the sheet processing apparatus.

DESCRIPTION OF THE EMBODIMENTS

Figure 1:
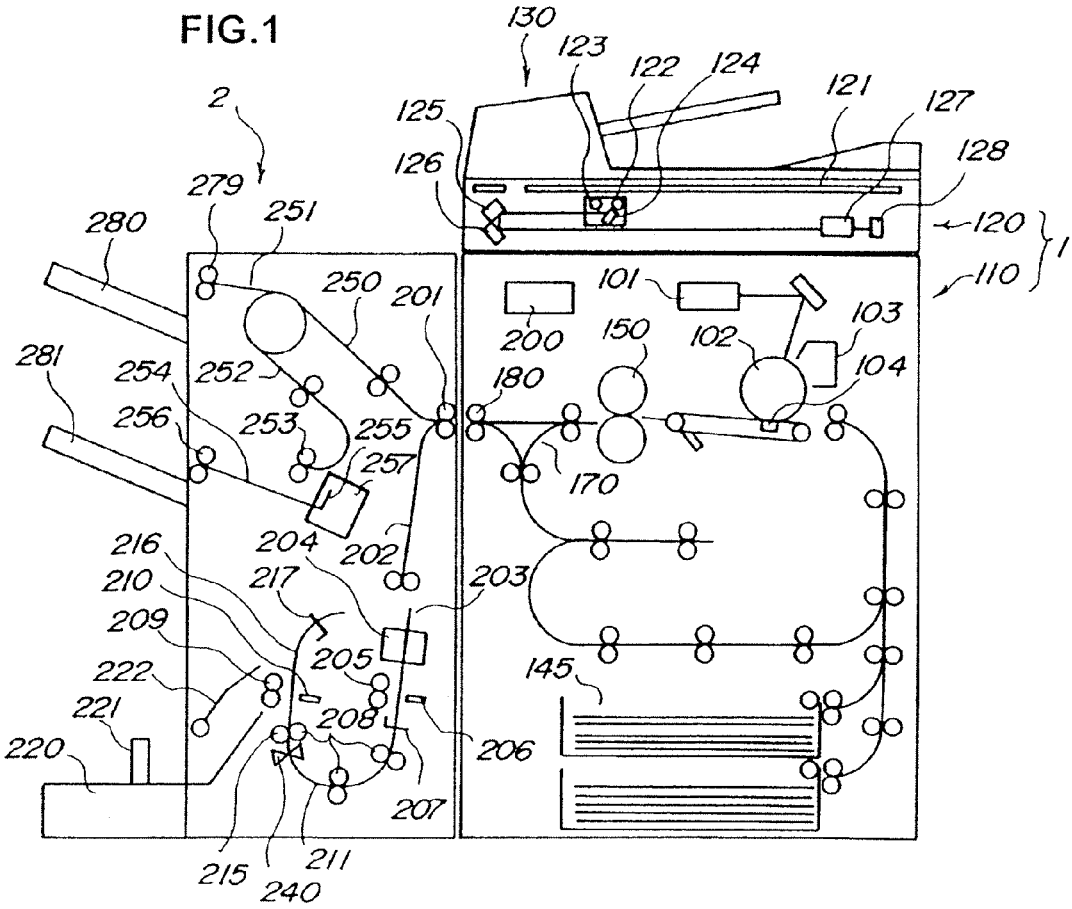
FIG. 1 shows an image forming apparatus provided with a sheet processing apparatus according to a first embodiment of the invention.
Figure 2:
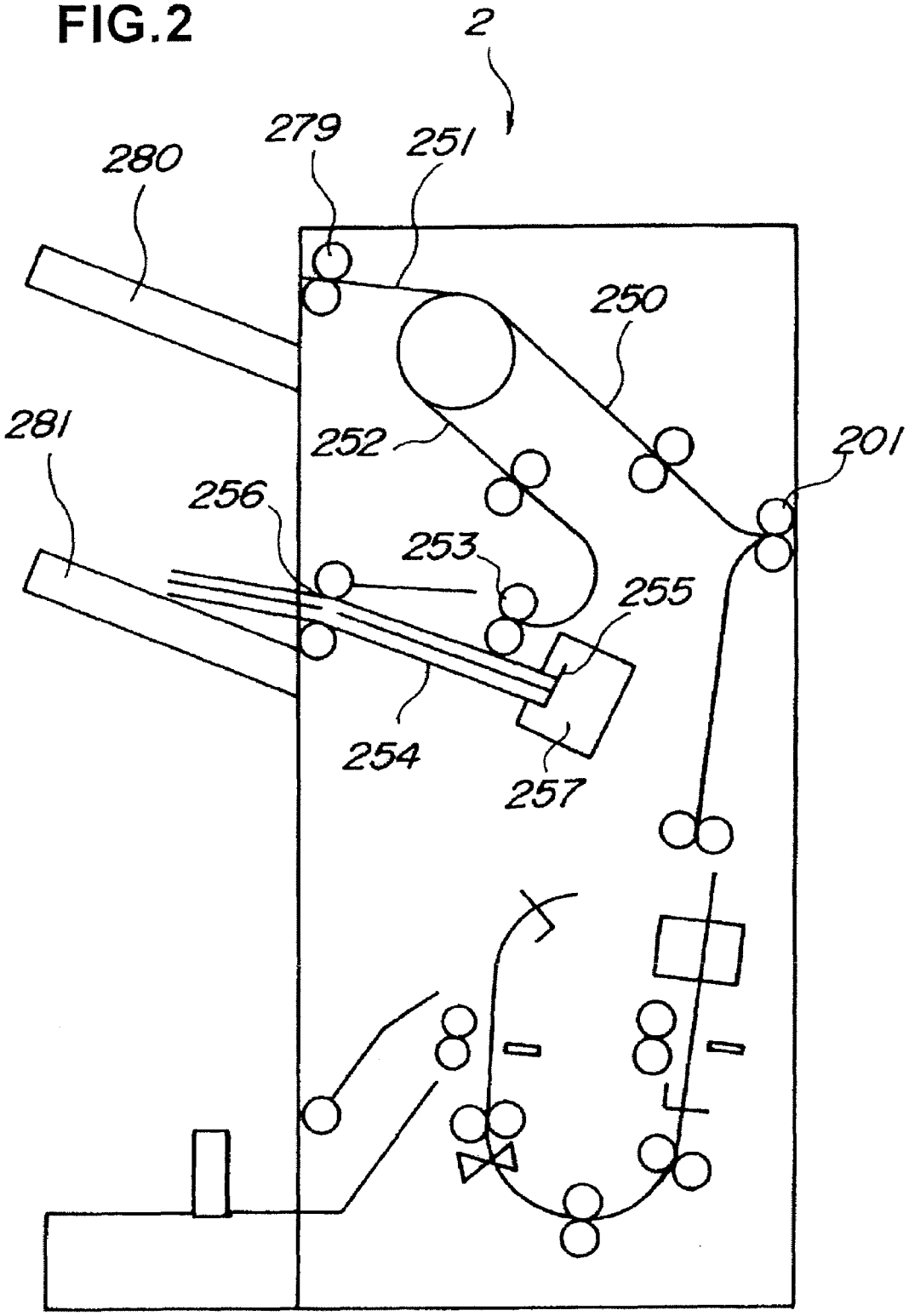
FIG. 2 shows the sheet processing apparatus of the first embodiment.

A sheet processing apparatus and an image forming apparatus and a sheet processing method according to a preferred embodiment of the invention will be described in detail with reference to the accompanying drawings.

(Image Forming Apparatus)

The image forming apparatus will be described with reference to FIG. 1 so that the sheet processing apparatus of the present embodiment can be easily understood. An image forming apparatus 1 includes an apparatus main body 110 and plural kinds of recording sheet cassettes inside the apparatus main body 110. The apparatus main body 110 outputs image data in the form of a visible image on a recording sheet by a print command. The image forming apparatus 1 also includes an image input device 120 which converts an original into the image data. A sheet processing apparatus 2 of the first embodiment is attached to the image forming apparatus 1, and the sheet processing apparatus 2 performs various kinds of processing such as saddle stitching processing to the discharged sheet in which the image is already formed. The image forming apparatus 1 also includes a control device 200 which controls the whole system based on a predetermined program. The control device 200 outputs a control signal and a command signal to control the actions of the image input device 120, the apparatus main body 110, the sheet processing apparatus (finisher) 2, and the like based on the predetermined program. The image forming apparatus 1 also includes an operation panel (not shown) having a display portion through which a user confirms pieces of necessary information concerning an input signal, selected and operated by the user, and setting of an action mode or an action status of various kinds of the processing. In the first embodiment, the control device 200 on the side of the apparatus main body 110 controls sheet processing apparatus 2. Alternatively, a finisher control portion may be provided on the side of the sheet processing apparatus 2. In this case, signal is exchanged between the finisher control portion on the side of the sheet processing apparatus 2 and the control device 200 on the side of the apparatus main body 110, and the finisher control portion controls the whole of the sheet processing apparatus 2.

The original stacked on an original feeding device 130 is sequentially conveyed onto an original base plate glass surface 121 one by one. When the original is conveyed, a lamp of a scanner portion 122 is lit to irradiate the original while a scanner unit 123 is moved. The light reflected from the original passes through mirrors 124, 125, and 126 and a lens 127 in this order, and the reflected light is inputted to an image scanner 128 which is of an image input portion with CCD (Charge Coupled Device). CCD performs photo electric conversion of the inputted image information into an electric signal. Various kinds of image processing are performed to the converted signal, and the signal is inputted to the apparatus main body 110 to form the image as the visible image. In the first embodiment, the image input device 120 which converts the original into the image data inputs the signal to the apparatus main body 110. However, the invention is not limited to the first embodiment. For example, the image data may be transmitted from a personal computer or a host computer which is of an upper-level apparatus.

The signal inputted to the apparatus main body 110 is converted into a light signal by an exposure controlling portion 101, and a photosensitive member 102 is irradiated based on the image signal. A latent image formed on the photosensitive member 102 by the irradiating light is developed by a development device 103 which constitutes an image forming portion along with the photosensitive member 102. In the sheet which is fed from sheet feeding portion 145 while timed to the development, the developed image is transferred to by a transfer portion 104, and the transferred image is fixed by a fixing portion 150. The sheet discharged from the fixing portion 150 is reversed by a reversal path 170 if needed, and the sheet is discharged to the sheet processing apparatus 2 by a discharge roller 180.

(Sheet Processing Apparatus)

Then, a configuration of the sheet processing apparatus 2 of the first embodiment will be described in each processing mode along with a sheet flow.

(Staple Sort Mode)

Referring to FIG. 1, in a staple sort mode, an entrance-side roller 201 receives the image-formed sheet discharged from the image forming apparatus 1. The sheet is introduced to a first conveyance path 250 by a switching action of a switching-over flapper (not shown), and the sheet is directed to a second conveyance path 252 for sort conveyance. When the staple sort mode is not set, the sheet is directed to a non-sort conveyance path 251, and the sheet is discharge and stacked on a stack tray 280 by a discharge roller 279.

The sheet directed to the second conveyance path 252 for sort conveyance is stacked on a processing tray 254 by a conveyance roller 253. The processing tray 254 is arranged with a predetermined inclined angle such that the sheet abuts on a sheet rear end regulating member 255 provided at an end portion of the processing tray 254. Accordingly, the sheet abutting on the sheet rear end regulating member 255 stand by for a given time and the sheet is aligned by a sheet alignment member (not shown) in a sheet width direction. When a sheet alignment action is finished for the predetermined number of sheets, a stapling process is performed to rear end portions of the sheets by a stapler 257. Then, the sheet bundle is discharged to and stacked on a stack tray 281 by a bundle discharge roller 256.

(Saddle Stitch Mode)

Figure 10:
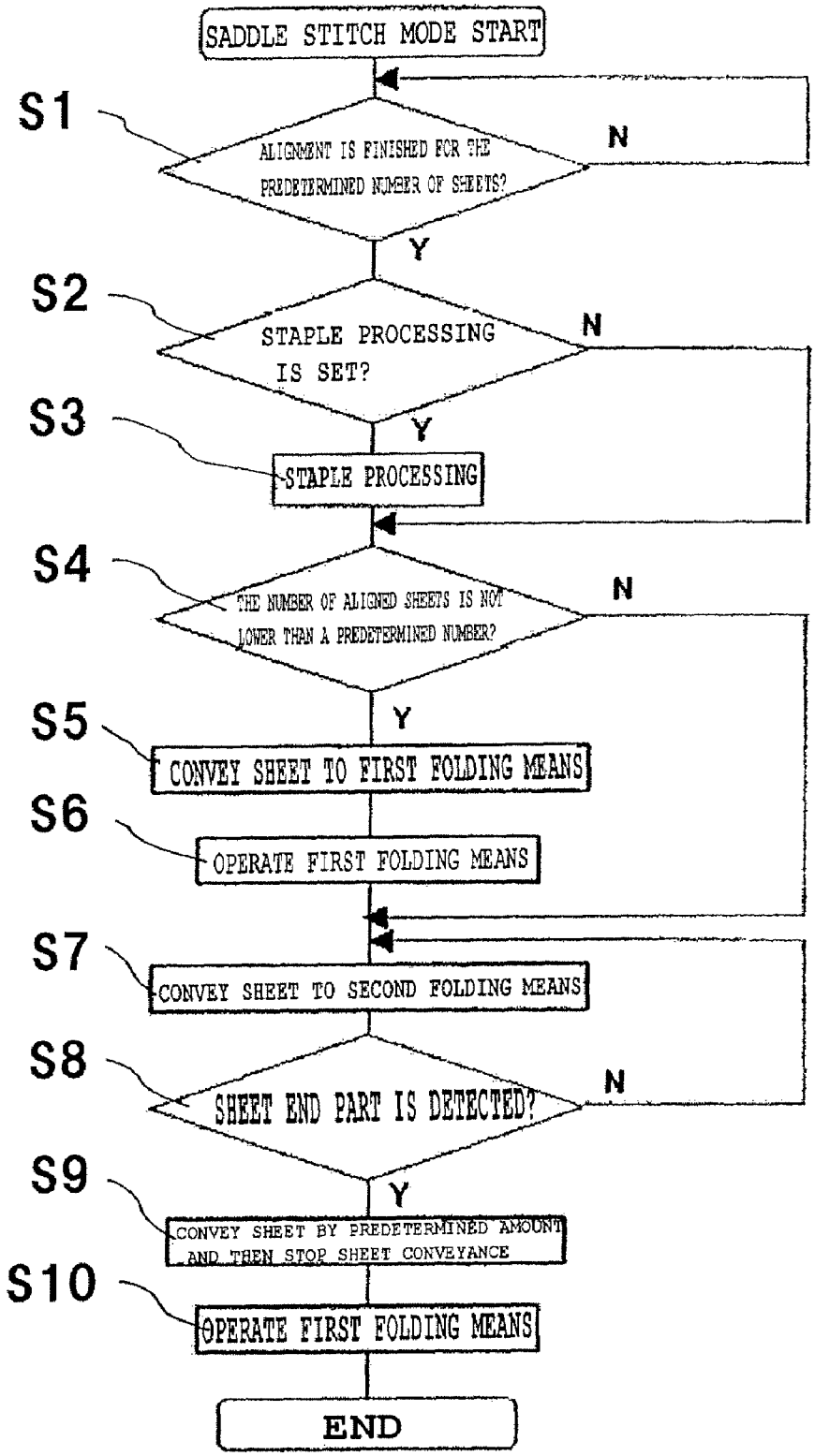
FIG. 10 is a flowchart showing an action in the sheet processing apparatus of the first embodiment.

Referring to FIG. 1, in the setting of a saddle stitch mode, the sheet conveyed into the sheet processing apparatus 2 from the entrance-side roller 201 is directed to a saddle stitch conveyance path 202 by the switching action of the switching-over flapper, and the sheet is conveyed in a saddle stitch sheet storage portion 203 by a conveyance roller 215. FIG. 10 is a flowchart showing an action of the saddle stitch mode. The saddle stitch action is performed according to Steps S1 to S10.

As shown in FIGS. 3 to 9, the conveyed sheet is aligned and stored one by one in the sheet storage portion 203. During this time, a sheet detection sensor or counter device whether or not the number of conveyed sheets reaches a setting number (Step S1), and information whether or not the staple processing is performed is previously obtained (Step S2). The sheet conveyed in the sheet storage portion 203 is aligned while a front end in the sheet conveyance direction abutting on a movable stopper 207, and the sheet is also aligned in the sheet width direction by a alignment plate 219. These alignment actions are performed to the predetermined number of sheets. The movable stopper 207 is formed to be movable toward an upstream side and a downstream side in the conveyance direction in the sheet storage portion 203, and the movable stopper 207 is also a member for adjusting a position corresponding to a sheet size.

Figure 3:
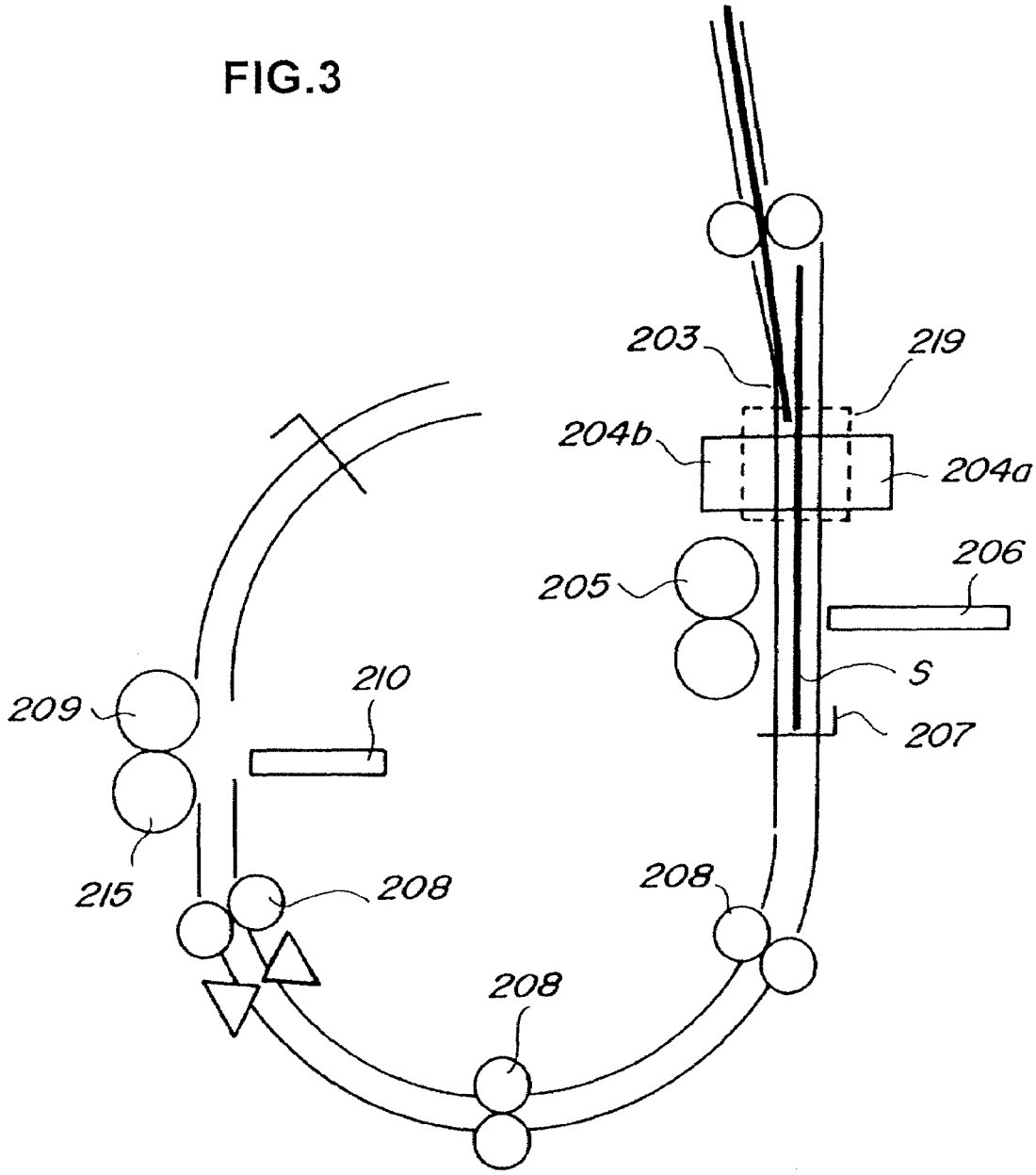
FIG. 3 shows a sheet bundle folding action in a main part of the sheet processing apparatus of the first embodiment.

The conveyance roller 215 is arranged on a left side of the sheet storage portion 203 such that the subsequent sheet is conveyed onto the left side of FIG. 3 with respect to the conveyed previous sheet, that is, onto the side the subsequent sheet faces the first folding roller 205 in storing the sheet in the sheet storage portion 203. The sheet storage portion 203 is provided while slightly inclined toward the right in the drawing in order to preferably accomplish the function, which avoids a trouble that the discharge sheet and the already stacked sheet interfere with each other.

Figure 4:
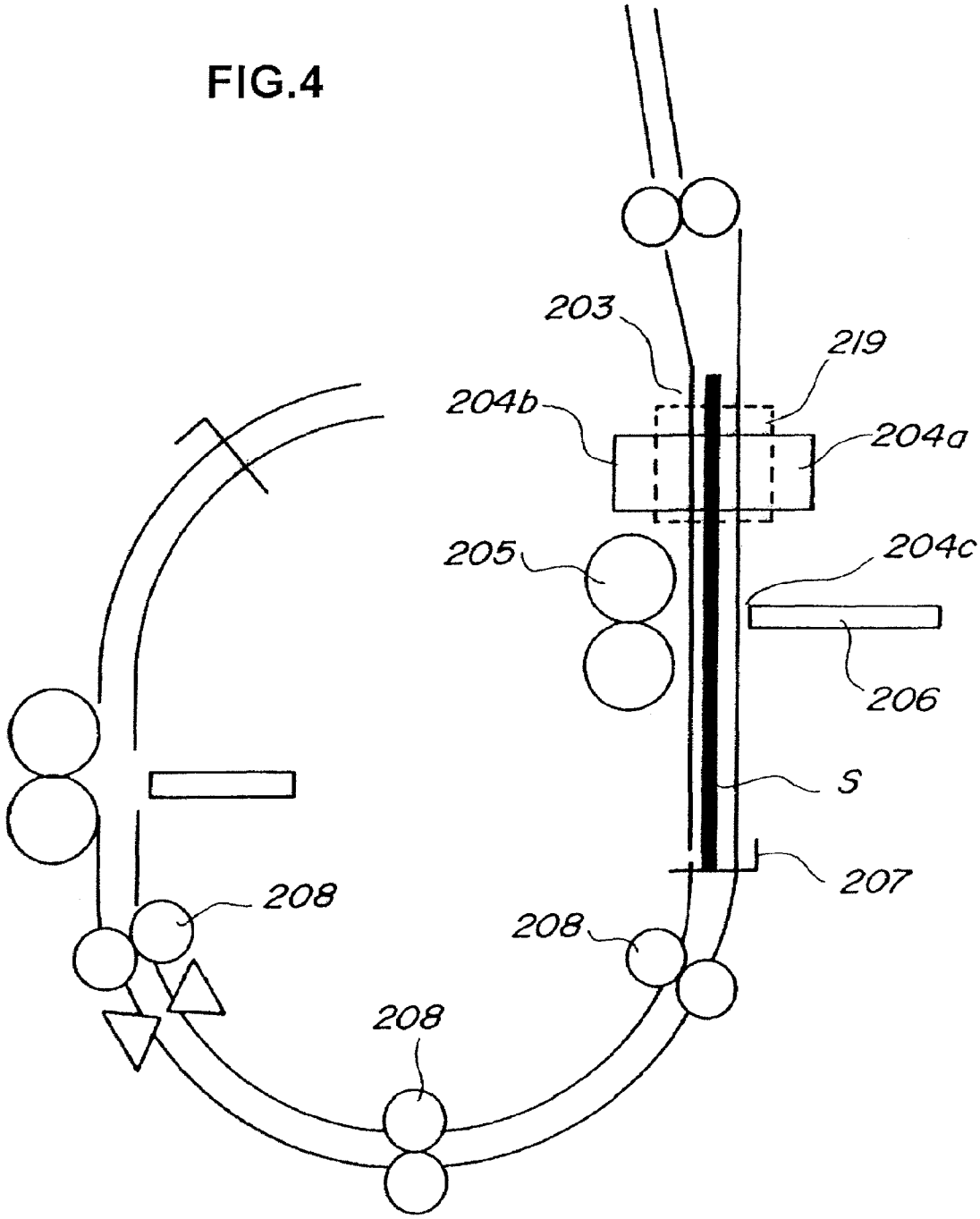
FIG. 4 shows the sheet bundle folding action in the main part of the sheet processing apparatus of the first embodiment.

As shown in FIG. 3, the alignment is finished to the sheet bundle (hereinafter the sheet bundle is designated with a letter S) having the predetermined number of sheets sequentially stored in the sheet storage portion 203. At this point, when the stapling process is set, the stapling process is performed to a central portion in the conveyance direction of the aligned sheets with a pair of a stapler main body 204*a* and an anvil portion 204*b* which face each other (Step S3). As shown in FIG. 4, the stapler main body 204*a* is arranged on the right side of the sheet storage portion 203 while the anvil portion 204*b* is arranged on the left side such that a staple leg 204*c* corresponds to the nip portion direction of the first folding roller 205.

Figure 5:
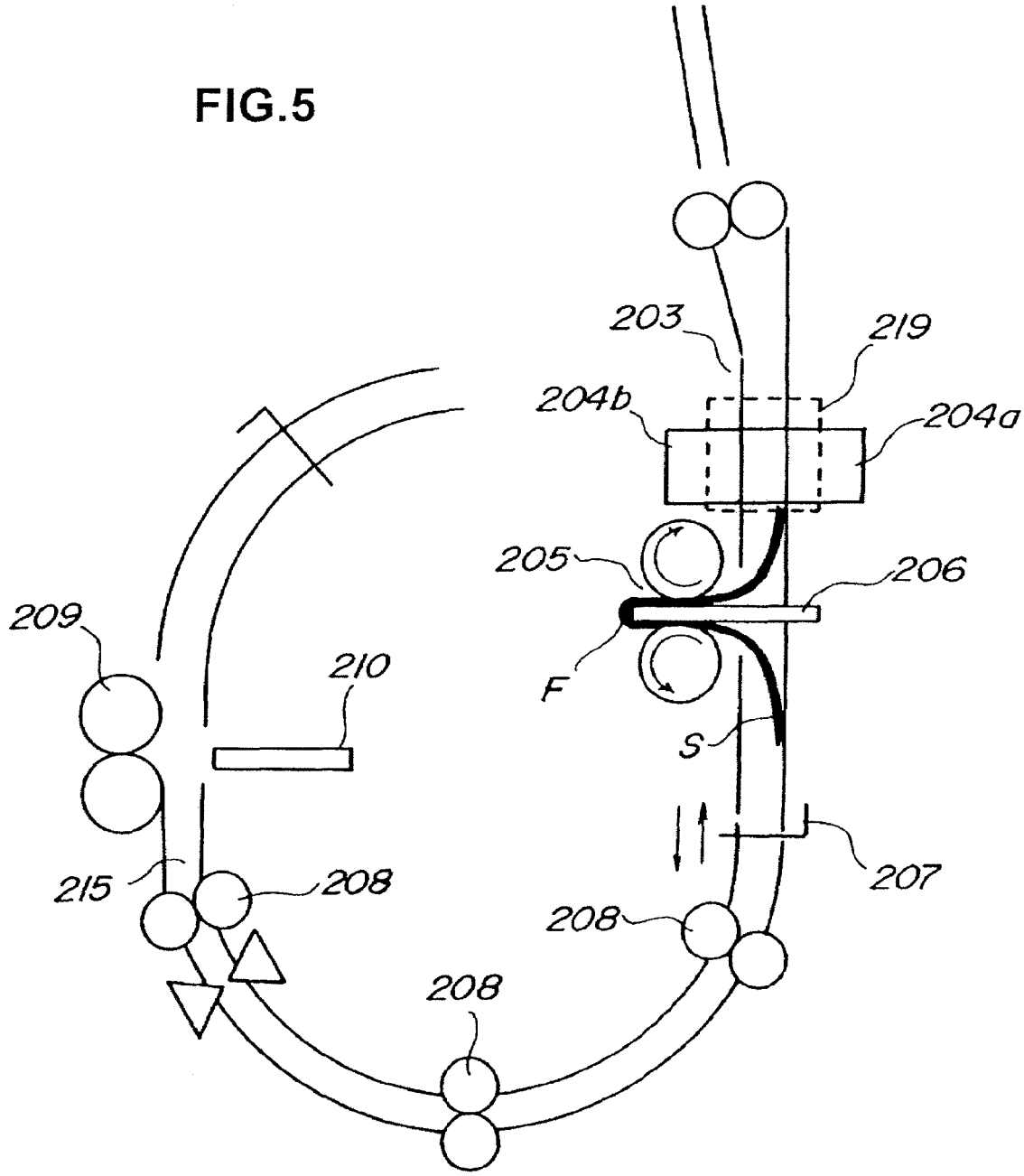
FIG. 5 shows the sheet bundle folding action in the main part of the sheet processing apparatus of the first embodiment.

In the sheet bundle S conveyed to the sheet storage portion 203, the position is adjusted by moving the movable stopper 207 by a predetermined amount in the upstream or downstream direction according to the sheet size. After the stapling process is performed if needed, the central portion in the sheet conveyance direction of the sheet bundle S (corresponds to the wire-stitched portion in the bind where the stapling process is performed) is conveyed near the nip between the first folding rollers 205, and a first pushing plate (first pushing member) 206 is caused to proceed toward the nip direction of the first folding roller 205. As shown in FIG. 5, the sheet bundle S is center-folded at the central portion to make a fold F by a plunging action of the first pushing plate 206 (Steps S5 and S6). The first pushing plate 206 constitutes "first folding unit" along with the first folding roller 205.

At this point, the first pushing plate 206 is plunged into the nip portion of the first folding rollers 205 along with the sheet bundle S. This is because the trouble generated by the difference between a frictional coefficient between the sheets inside the sheet bundle and a frictional coefficient between the cover sheet of the sheet bundle S on the side which is in contact with the first folding roller 205 and the roller surface is eliminated. Sometimes the conveyance amount of cover sheet which comes into contact with the roller surface to receive conveyance force is larger than the conveyance amount of inside sheet of the sheet bundle S due to the difference in frictional coefficient. That is, the shift of the conveyance amount between the cover sheet and the inside sheet in the sheet bundle S causes the generation of the breakdown or wrinkle to remarkably decrease bundle fold quality or binding quality. In order to prevent the decrease in bundle fold quality or binding quality, the first pushing plate 206 is followed by the sheet bundle S and nipped between the first folding rollers 205.

Conventionally, when only the first pushing plate 206 is brought close to the nip portion of the first folding roller 205, there is generated the trouble that scratch or frictional trace occurs inside the sheet of the sheet bundle S pushed by the first pushing plate 206. However, the trouble can be eliminated by pushing the sheet bundle S into the nip portion of the first folding roller 205 along with the first pushing plate 206.

Figure 6:
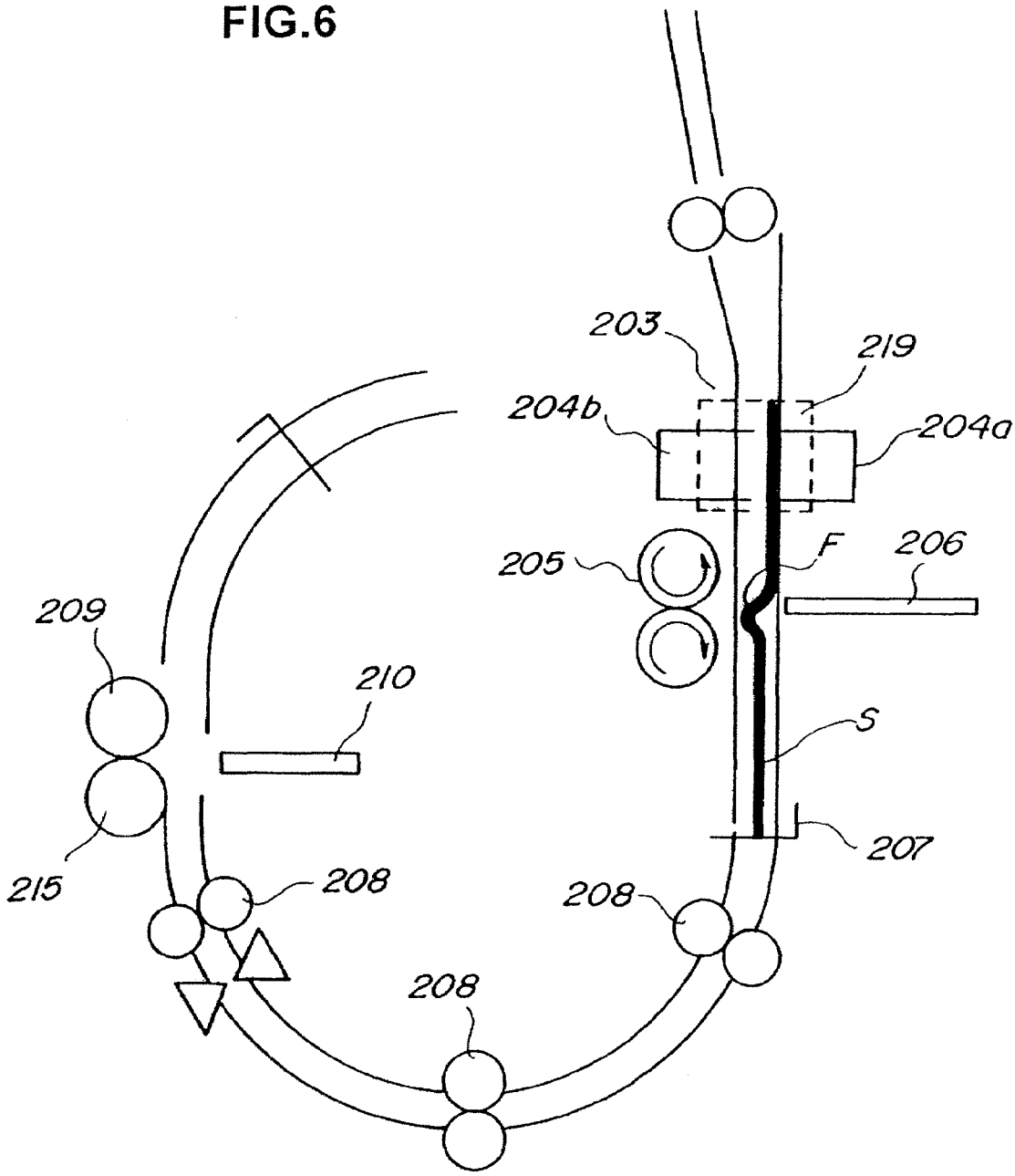
FIG. 6 shows the sheet bundle folding action in the main part of the sheet processing apparatus of the first embodiment.
Figure 7:
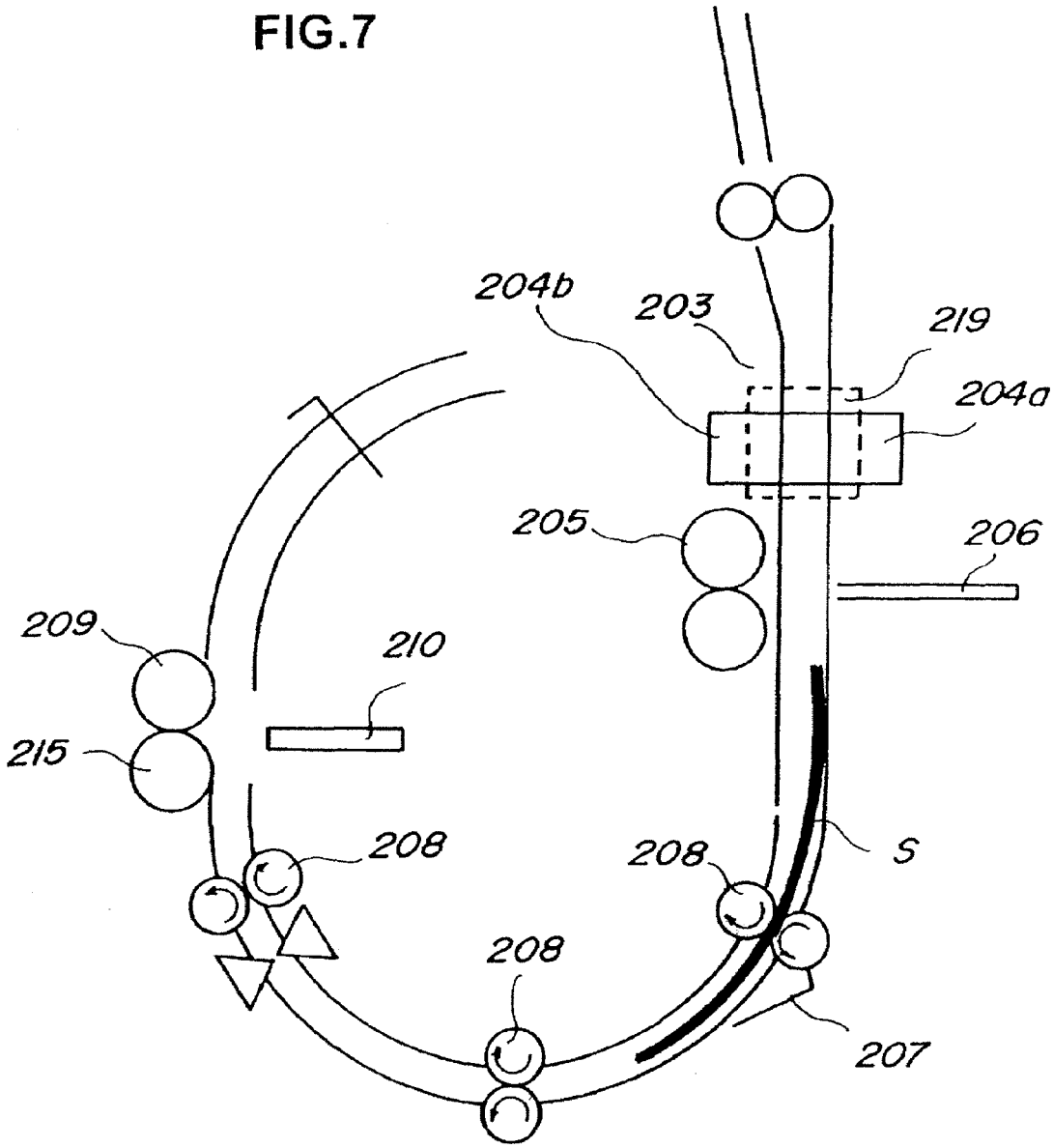
FIG. 7 shows the sheet bundle folding action in the main part of the sheet processing apparatus of the first embodiment.

The sheet bundle S is conveyed by the predetermined conveyance amount while the first pushing plate 206 pushes the sheet bundle S into the first folding roller 205. Then, as shown in FIG. 6, the first folding roller 205 is reversely rotated by an operational signal from the control device 200, and the sheet bundle S is returned toward the sheet storage portion direction. The first pushing plate 206 is also retreated toward the sheet storage portion direction in synchronization with the reversal rotation of the first folding roller 205. In the sheet bundle S returned to the sheet storage portion 203, one end (lower end in FIG. 6) of the sheet bundle S abuts on the movable stopper 207 again. As shown in FIG. 7, the movable stopper 207 is further moved in the downstream direction and followed by the sheet bundle S, the sheet bundle S is transferred to a conveyance roller 208 in the path, and the sheet bundle S is further conveyed onto the downstream side (Step S7). The conveyance roller 208 is a member which constitutes "conveyance portion" along with the conveyance path 215.

Figure 8:
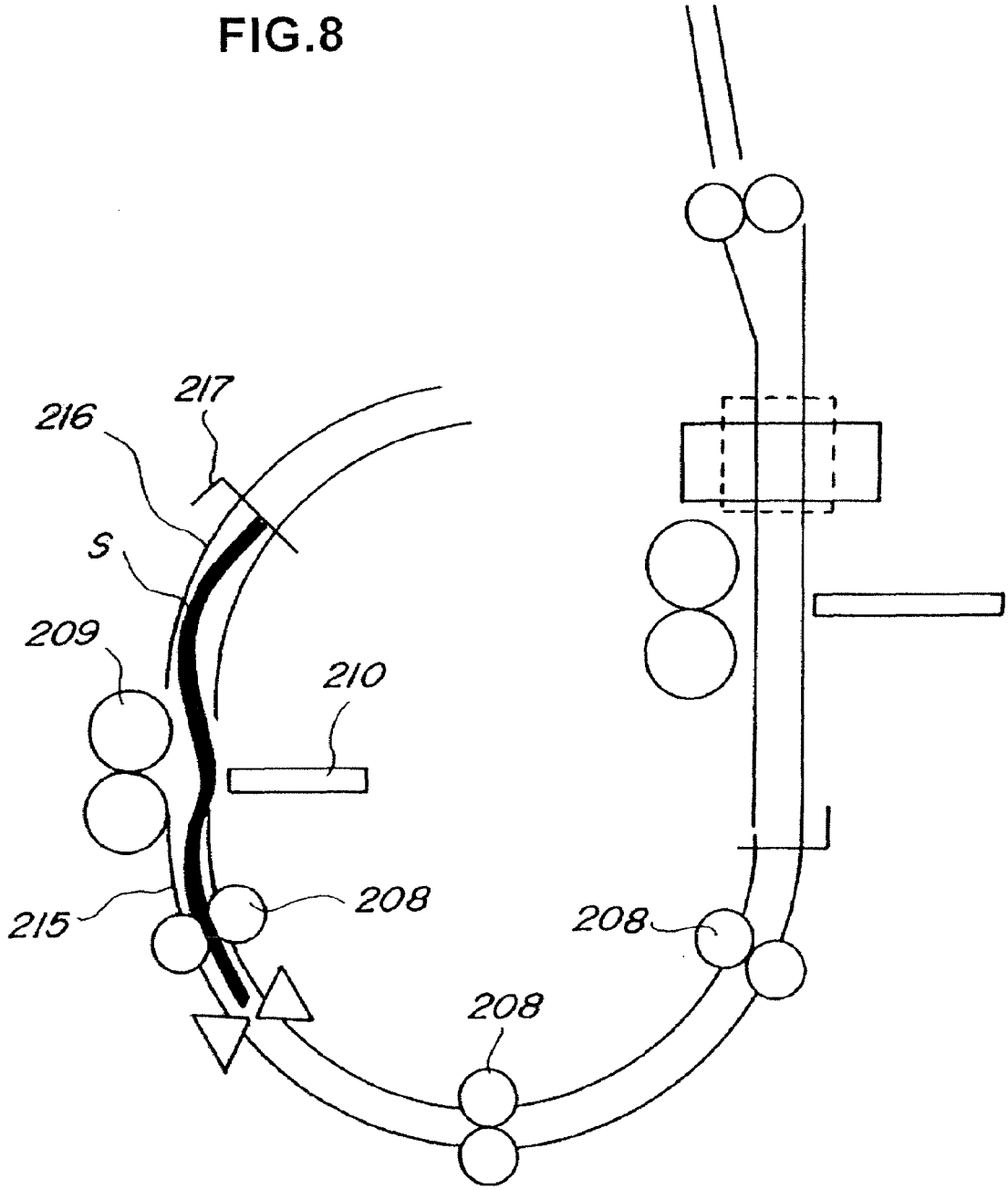
FIG. 8 shows the sheet bundle folding action in the main part of the sheet processing apparatus of the first embodiment.

During the conveyance of the sheet bundle S onto the downstream side, the rear end of the sheet bundle S is detected by a bundle detection sensor 240 (Step S8). The detection signal stops the conveyance performed by the rotation of the first folding roller 205 at the position where the sheet bundle S proceeds slightly toward the down stream side (Step S9). As shown in FIG. 8, the stop position is set such that the fold is made in the sheet bundle S by the first folding roller 205, that is, the central portion in the sheet conveyance direction corresponds to the nip position of the second folding rollers 209.

At this point, the control device 200 performs the control such that the position of the fold F of the sheet bundle S which is folded by the first folding rollers 205 is conveyed to the nip position of the second folding rollers 209. Therefore, in a conveyance path 215 to the second folding rollers 209 on the downstream side of the bundle detection sensor 240 in FIG. 8, a path width size is formed narrower than that of a conveyance path 216 on the downstream side of the second folding rollers 209. This enables the conveyance to be accurately performed while a conveyance load is reduced.

The conveyance path 215 between the first folding rollers 205 and the second folding rollers 209 is formed in a U-shape in which the path is bent by about 180°, which realizes the compact configuration of the sheet processing apparatus main body. In the first embodiment, the miniaturization of the sheet processing apparatus main body is realized by bending the conveyance path 215. However, the bent angle is not limited to 180° as long as the miniaturization is achieved by forming the conveyance path 215 in the curved shape.

A length of the conveyance path 215 between the first folding roller 205 and the second folding roller 209 is set longer than the maximum sheet size to which the saddle stitch can be performed. Therefore, when the second folding roller 209 is driven, the rear end of the sheet bundle S is located on the downstream side of the movable stopper 207 which allows the sheet storage portion 203 to become an empty state to receive the next sheet bundle S. As a result, the total productivity is not decreased as the image forming system because the conveyance can be continued without stopping the processing between the previous sheet bundle S and the subsequent sheet bundle S.

Figure 9:
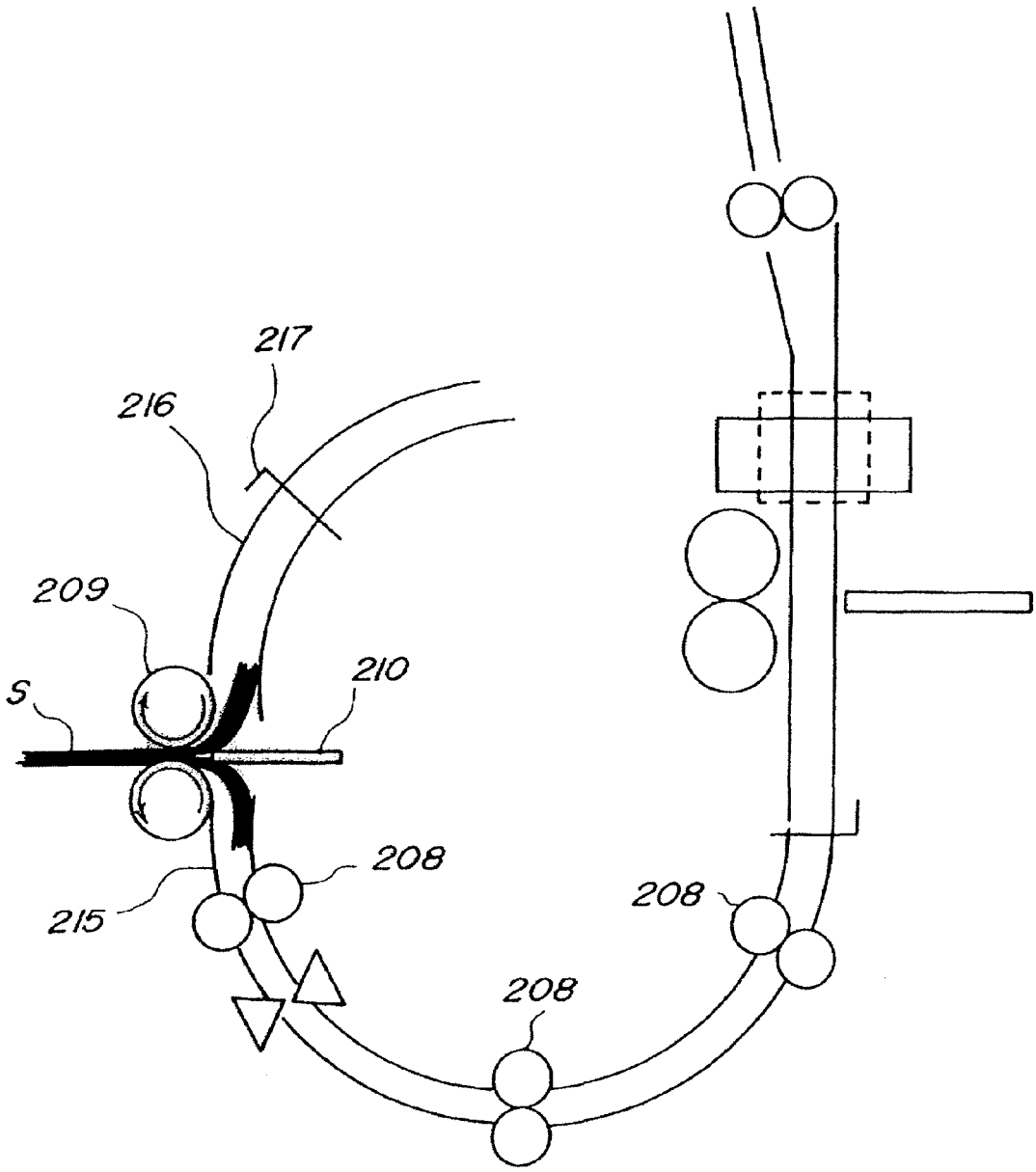
FIG. 9 shows the sheet bundle folding action in the main part of the sheet processing apparatus of the first embodiment.

Then, as shown in FIG. 9, a second pushing plate (second pushing member) 210 is plunged into the sheet bundle S conveyed to the nip position of the second folding roller 209. The direction in which the second pushing plate 210 is plunged is opposite the direction in which the first pushing plate 206 is plunged the sheet bundle S to make the fold F by the first folding rollers 205 (Step S10). The sheet bundle S is completely folded by pushing the sheet bundle S into the nip portion of the second folding rollers 209 such that the second pushing plate 210 is plunged from the opposite direction to the direction in which the fold F is made by the first folding rollers 205. In the folded sheet bundle, the fold becomes looser in the sheet located on the outside of the fold. However, when the folding processing is performed from the opposite direction to the direction in which the fold is made once, the outside and the inside inverts after the sheet bundle is folded, and the folding processing in which the folded radius is small is performed to the outside sheet in which the folded portion has the large folded radius in the first-time folding. Therefore, the both the ends are never opened after the folding processing is performed from the opposite direction to the direction in which the fold F is made by the first folding unit.

At this point, the plunging action of the second pushing plate 210 is set so as to be stopped immediately before the nip of the second folding rollers 209. The scratch or frictional trace never generates because the second pushing plate 210 is plunged from the opposite direction to the direction in which the fold F is made. The second pushing plate 210 and the sheet bundle S hardly slide because a fold habit in the direction in which the sheet bundle S is separated away from the second pushing plate 210 is made to the sheet S by the first folding unit. In the first embodiment, the second pushing plate 210 is a member which constitutes "second folding unit" along with the second folding rollers 209. Thus, the sheet bundle having good appearance can be realized in bundle good folding processing.

In the folding processing, the second pushing plate 210 is plunged toward the fold F of the sheet bundle S to which the fold is made. At this point, because a mountain peak is aimed, the front end of the second pushing plate 210 does not always correspond to the fold F at an initial stage of the plunging action. However, because the folding processing is already performed to the fold F by the first folding unit, the sheet rigidity is locally decreased in the fold F. Accordingly, as the plunging action of the second pushing plate 210 is in progress, a turnoff in the reversal direction is generated along the fold F, and the fold F corresponds to the front end of the second pushing plate 210. In order to further secure the plunging action to the fold F, the shapes of the conveyance path 215 on the upstream side and the conveyance path 216 on the downstream side are curved in the reversal direction of the direction in which the fold is made such that the sheet bundle S is stably pushed into the nip portion between the second folding rollers 209. That is, the conveyance path 215 on the upstream side and the conveyance path 216 on the downstream side are curved in the direction in which the conveyance path 215 and the conveyance path 216 are separated away from the second folding rollers 209 such that the neighbor of the fold of the sheet bundle S becomes a top of the curved portion toward the second folding roller 209.

Then, the sheet bundle S to which the folding processing is performed by the second folding rollers 209 is directly conveyed, and the sheet bundle S is discharged to and stacked on the stack tray 220. The folded sheet bundle S discharged to the stack tray 220 abuts on the movable stopper 221 (see FIG. 1), the front end of the folded portion is regulated, and the sheet bundle S is stacked while moved in association with the movable stopper 221 which is moved in downstream direction according to the number of discharged sheet bundles S (the number of copies). Therefore, the stacked sheet bundles S are neatly on top of another with good appearance. The numeral 222 designates a pressing member which presses the sheet bundle S stacked on the stack tray 220 from above the sheet bundle S.

In the sheet bundle S finished through the above procedure, the staple leg in the wire-stitched portion of the sheet bundle S center-folded in the folding processing by the second folding rollers 209 is located inside the center-folded sheet bundle S. The folding processing is performed from the reversal direction at the position where the first-time folding processing is already performed. Therefore, as the number of sheets is increased in the sheet bundle S, the quality is improved in the folding processing, and the sheet bundle S has becomes good-looking because the both the ends of the folded portion are never opened when compared with the conventional sheet bundle to which the one-time folding processing is performed. The binding processing can orderly be performed because the disorder caused by the stacking collapse is not generated.

In the first embodiment, for example, when plain paper sheets is set to predetermined sheets or less, for example, three or less in the saddle stitch mode, the action of making the fold F in the folding processing by the first folding rollers 205 can be neglected. In this case, the folding processing is performed only by the second folding rollers 209, and the sheet bundle S can directly be saddle-stitched (FIG. 10, Step S4). This is because the image formation might temporarily be interrupted in the subsequent sheet bundle S depending on a processing time necessary to make the fold F of the previous sheet bundle S with the first folding rollers 205. That is, the two-time folding processing is not performed to the sheet bundle S having the small number of sheets because the productivity is decreased in the image forming system depending on the number of sheets constituting the sheet bundle S. However, when a thickness of the sheet bundle S is increased, the saddle-stitched sheet bundle S is easily opened even if the number of sheets is small. Therefore, in a thick paper setting (105 g or more), the folding processing can be performed to make the fold F with the first folding rollers 205 even if the number of sheets is not more than a predetermined number. Accordingly, the judgment whether or not the first folding roller 205 is operated is made based on the number of sheets and the sheet thickness in the sheet bundle S. Obviously the judgment can be made based on only the information on the number of sheets or the information on the sheet thickness.

In the first embodiment, the case in which the fold is made at the predetermined position in the direction orthogonal to the sheet conveyance direction and the folding processing is reversely performed at the fold is explained. Alternatively, the fold may be made along the sheet conveyance direction and the folding processing is reversely performed at the fold.

Figure 11:
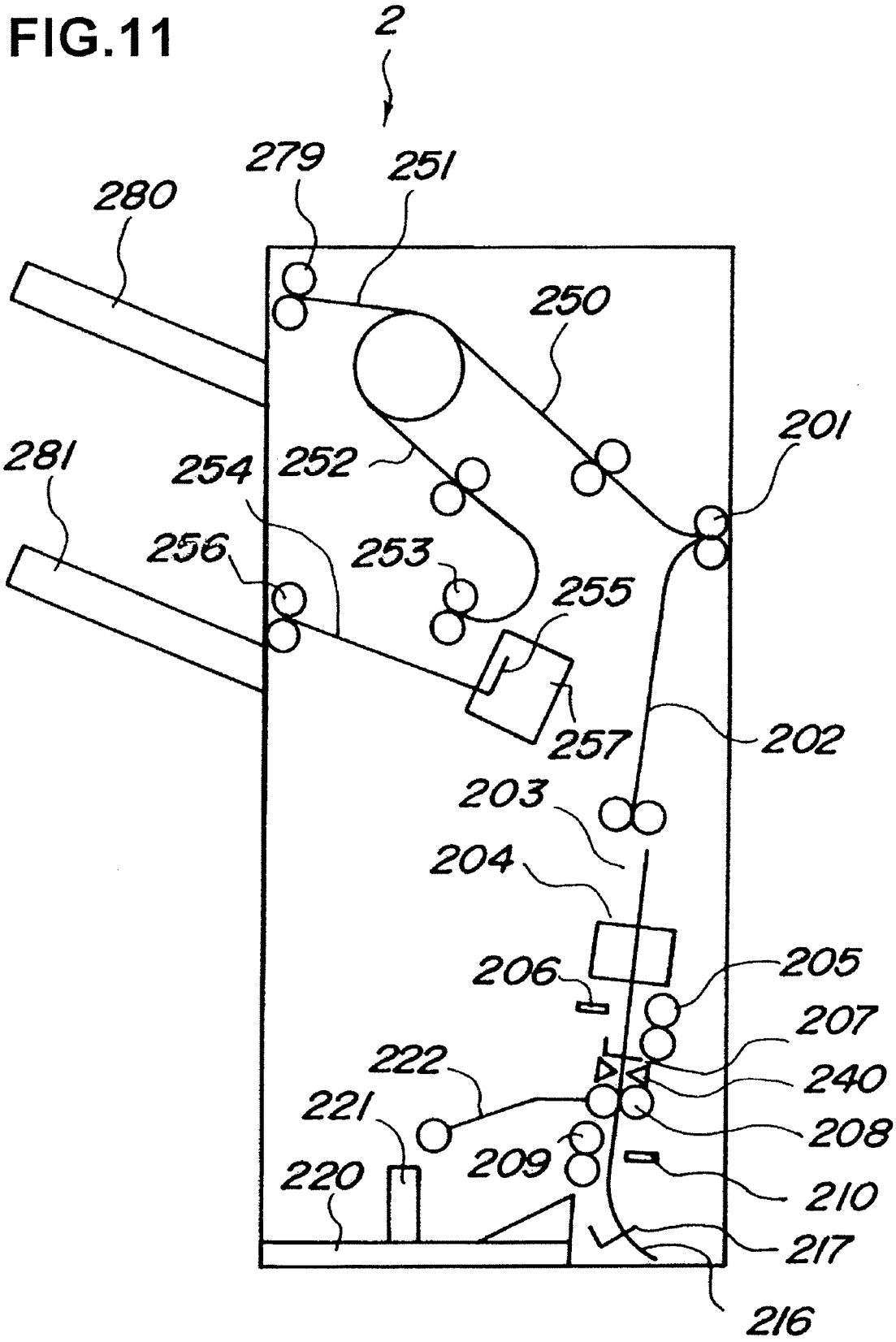
FIG. 11 shows a sheet processing apparatus according to a second embodiment of the invention.

FIG. 11 shows the sheet processing apparatus 2 according to a second embodiment.

In the first embodiment, the U-shape conveyance path 215 which is bent by about 180° is provided for the purposes of the miniaturization of the image forming apparatus 1 and the productivity improvement of the image forming system. On the other hand, in the second embodiment, the sheet processing apparatus 2 is miniaturized in the case of a type of image forming apparatus 1 having relatively low productivity per hour. For this end, the second folding rollers 209 are arranged on the downstream side of the first folding rollers 205 while brought close to the first folding rollers 205. While the folding processing is performed in either the first folding rollers 205 or the second folding rollers 209, the end portion of the sheet bundle to which the folding processing is being performed enters the folding processing position of the other sheet bundle to which the folding processing is not performed. That is, the folding processing is not simultaneously performed in the first folding rollers 205 and the second folding rollers 209. Instead the conveyance path length between the first folding rollers 205 and the second folding rollers 209 is reduced to minimal length to realize the miniaturization of the apparatus. In the second embodiment, the conveyance path is linearly provided, and thereby the miniaturization is also achieved in the direction orthogonal to the conveyance path. The miniaturization may be achieved by bending the conveyance path to further decrease the length in the conveyance direction.

Therefore, the miniaturization is realized in the sheet processing apparatus 2, the sheet bundle becomes good-looking because the folded portion is not opened, and the good binding processing can be performed.

Figure 12:
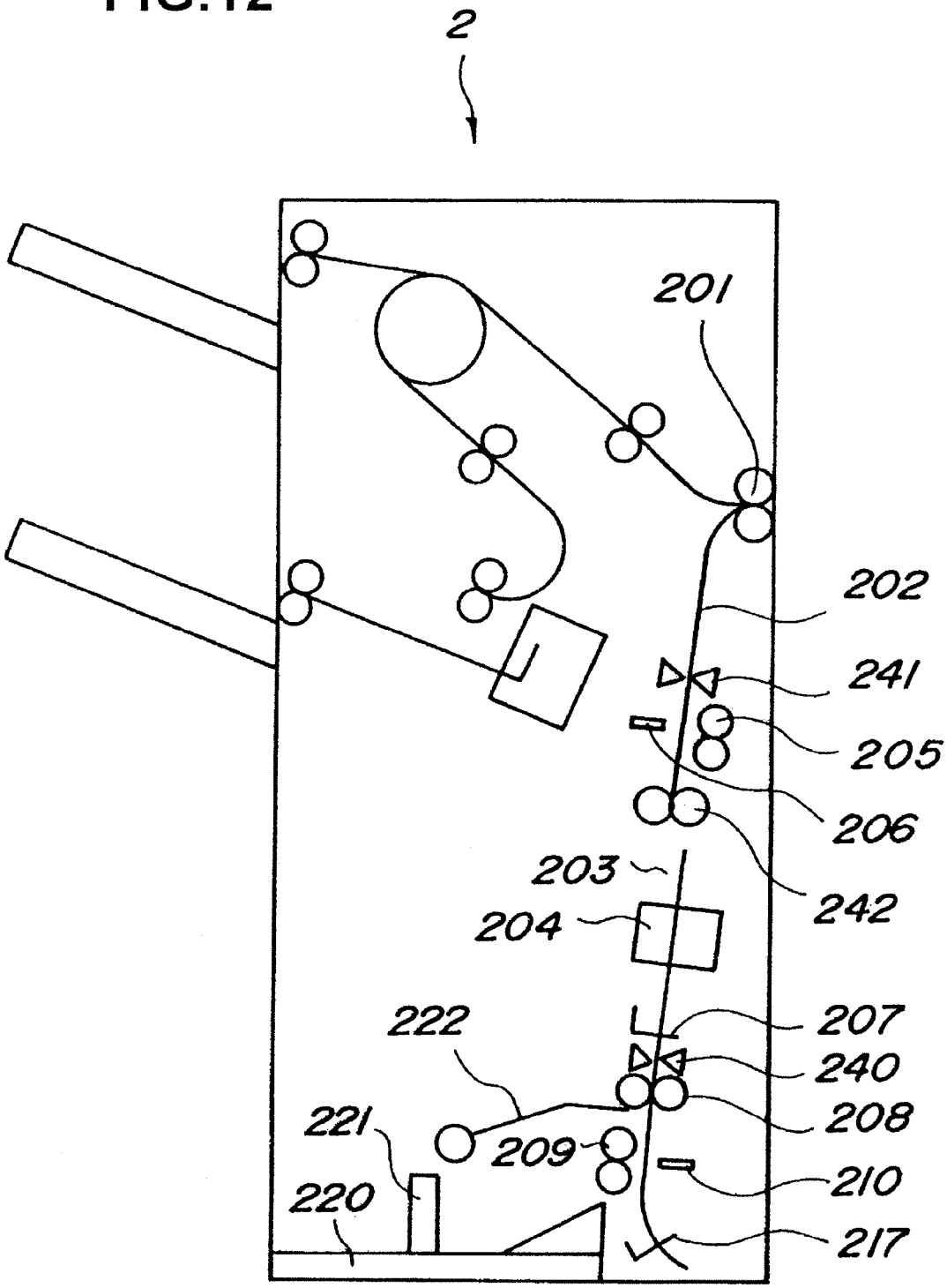
FIG. 12 shows a sheet processing apparatus according to a third embodiment of the invention.

FIG. 12 shows the sheet processing apparatus 2 according to a third embodiment.

In the first and second embodiments, the folding processing is collectively performed to the sheet bundle. On the other hand, in configuration of the third embodiment, the folding processing is performed to the sheet one by one by the first folding rollers 205 and the plural folded sheets are stacked by the sheet storage portion 203. Then, the staple processing is performed if needed, the second folding rollers 209 fold the sheet bundle S including the plural sheets toward the reversal direction of the first folding rollers 205, and thereby the folded portions becomes further good-looking and the stacking properties is improved. In the folding processing performed to the one sheet, depending the thickness of the sheet, the outside of the fold and the inside differ from each other in the folded radius. The difference becomes remarkable as the thickness is increased in the sheet. The folding processing is securely performed by folding the thick sheet one by one. Thus, after the fold is made to the sheet one by one, the folding processing is performed in the reversal direction, which allows the same effect as the first and second embodiments to be obtained even in the thick sheet. In this case, the discharge roller 242 is formed by a one-way clutch mechanism because the reversal rotation of the sheet conveyance direction is made free. That is, the sheet bundle S returned by the first folding rollers 205 is conveyed by the discharge rollers 242 again, and the sheet bundle S is delivered to the sheet storage portion 203 for the saddle stitch. Then, the front end in the sheet conveyance direction of the conveyed sheet bundle S abuts on the movable stopper 207, and the sheet width direction of the sheet bundle S is aligned by a pair of alignment plates 219 as alignment member in the sheet width direction. This processing is performed to the predetermined number of sheets.

Figure 13:
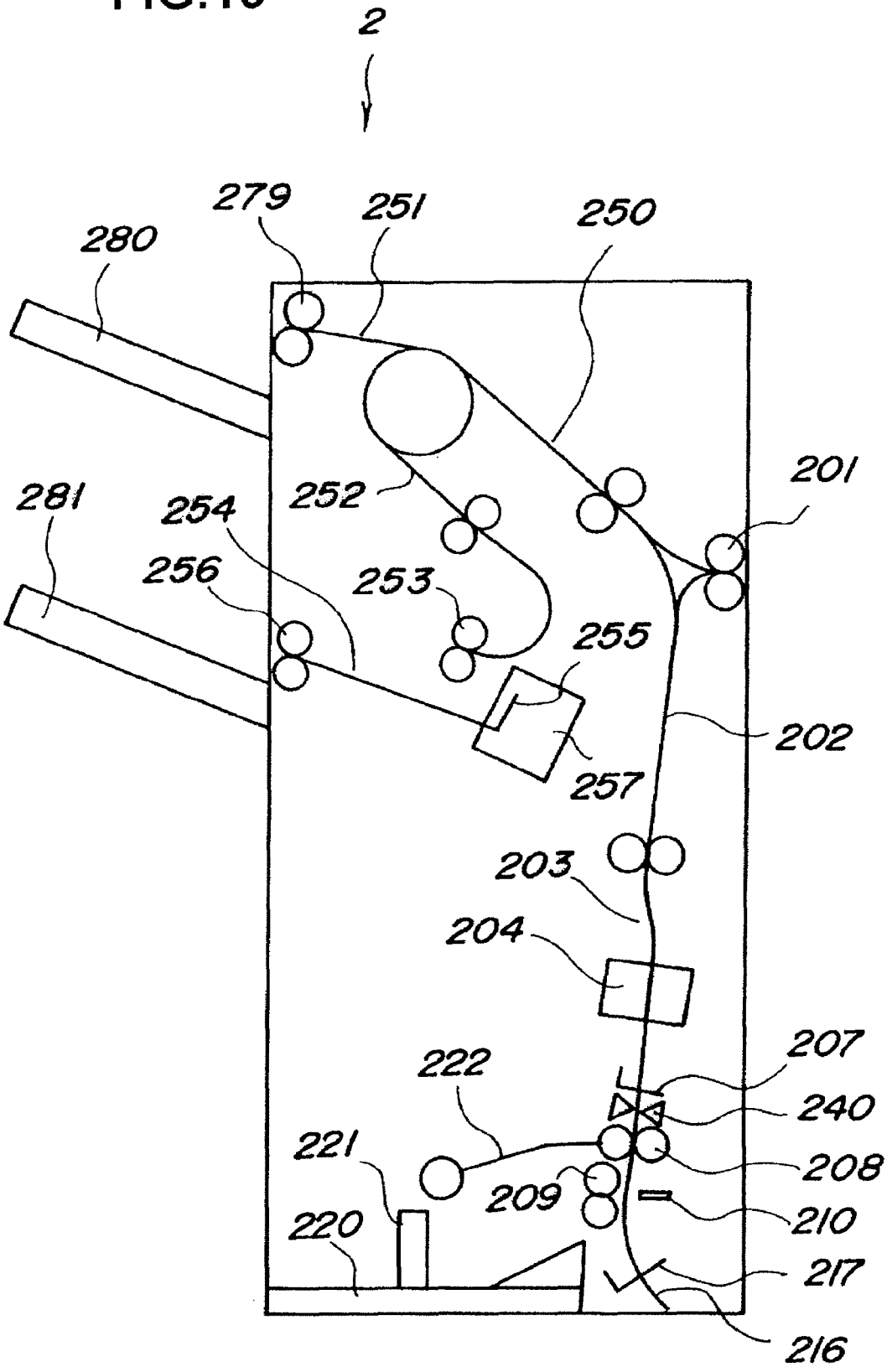
FIG. 13 shows a sheet processing apparatus according to another embodiment of the invention.

In the first, second, and third embodiments, the two folding means are provided, and the folding processing is performed in the reversal direction in each folding means. However, the invention is not limited to the above embodiments. For example, as shown in FIG. 13, in the sheet processing apparatus 2 in which the one folding means is provided, the first-time folding processing is performed by the folding rollers 209 and pushing plate 210 which constitute the folding means. The folded sheet bundle is reversely conveyed to the first conveyance path 250 through the saddle stitch conveyance path 202, and the sheet bundle is returned to the apparatus main body 110 through the entrance-side roller 201. The sheet bundle is reversed by conveying the sheet bundle, returned to the apparatus main body 110, to the folding means again. The folding processing is performed to the reversed sheet bundle, and thereby the folding processing is performed to the sheet bundle in the reversal direction of the first-time folding direction. Accordingly, the two-time folding processing can be performed even if the sheet processing apparatus includes only one folding means. Therefore, as with the first, second, and third embodiments, the sheet bundle has the good appearance and the good binding processing can be performed.

Thus, the preferred embodiments of the invention are described. Other embodiments, modifications, changes, and combinations thereof could be made without departing from the scope of the invention.

This application claims the benefit of priority from the prior Japanese Patent Application No. 2005-326887 filed on Nov. 11, 2005 and No. 2006-292011 filed on Oct. 27, 2006 the entire contents of which are incorporated by reference herein.

What is claimed is:

1. The sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit includes a first folding roller pair which folds the sheet or the sheet bundle while conveying the sheet or the sheet bundle and a first pushing member which pushes the sheet or the sheet bundle toward said first folding roller pair.

2. The sheet processing apparatus according to claim 1, wherein said first pushing member pushes the sheet or the sheet bundle between said first folding roller pair.

3. The sheet processing apparatus according to claims 1, wherein said second folding unit includes a second folding roller pair which folds the sheet or the sheet bundle while conveying the sheet or the sheet bundle and a second pushing member which pushes the sheet or the sheet bundle toward said first folding roller pair in the opposite direction to said first pushing member at said predetermined folding position.

4. A sheet processing apparatus comprising:

a first folding unit which performs folding processing to a predetermined folding position on a sheet or a sheet bundle;

a second folding unit which folds the sheet or the sheet bundle folded by said first folding unit in an opposite direction to said first folding unit at said predetermined folding position; and a conveyance path connecting said first folding unit and said second folding unit, wherein a length of said conveyance path is longer than a length in a conveyance direction of a foldable maximum sheet, and said conveyance path has a curved shape.

5. A sheet processing apparatus comprising:

a first folding unit which performs folding processing to a predetermined folding position on a sheet or a sheet bundle;

a second folding unit which folds the sheet or the sheet bundle folded by said first folding unit in an opposite direction to said first folding unit at said predetermined folding position; and a conveyance path connecting said first folding unit and said second folding unit, wherein a length of said conveyance path is shorter than a length from said predetermined folding position of a foldable sheet to an end portion of the foldable sheet in a conveyance direction, and said conveyance path has a curved shape.

6. A sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit processes the sheet one by one, and said second folding unit folds the plurality of sheets folded by said first folding unit while superimposing the sheets on top of another, and said first folding unit includes a first folding roller pair which folds the sheet while conveying the sheet and a first pushing member which pushes the sheet one by one toward said first folding roller pair.

7. A sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit processes the sheet one by one, said second folding unit folds the plurality of sheets folded by said first folding unit while superimposing the sheets on top of another, and said second folding unit includes a second folding roller pair which folds the sheet or the sheet bundle while conveying the sheet or the sheet bundle and a second pushing member which pushes the sheet or the sheet bundle toward said second folding roller pair in the opposite direction to said first folding roller pair at said predetermined folding position.

8. An image forming apparatus comprising:

an image forming portion which forms an image on a sheet; and a sheet processing apparatus which performs processing to the sheet or a sheet bundle on which the image is formed by said image forming portion, the sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit includes a first folding roller pair which folds the sheet or the sheet bundle while conveying the sheet or the sheet bundle and a first pushing member which pushes the sheet or the sheet bundle toward said first folding roller pair.

9. An image forming apparatus according to claims 8, said first pushing member pushes the sheet or the sheet bundle between said first folding roller pair.

10. An image forming apparatus according to claims 8, wherein said second folding unit includes a second folding roller pair which folds the sheet or the sheet bundle while conveying the sheet or the sheet bundle and a second pushing member which pushes the sheet or the sheet bundle toward said first folding roller pair in the opposite direction to said first pushing member at said predetermined folding position.

11. An image forming apparatus comprising:

an image forming portion which forms an image on a sheet; and a sheet processing apparatus which performs processing to the sheet or a sheet bundle on which the image is formed by said image forming portion, the sheet processing apparatus comprising:

a first folding unit which performs folding processing to a predetermined folding position on a sheet or a sheet bundle;

a second folding unit which folds the sheet or the sheet bundle folded by said first folding unit in an opposite direction to said first folding unit at said predetermined folding position; and a conveyance path connecting said first folding unit and said second folding unit, wherein a length of said conveyance path is longer than a length in a conveyance direction of a foldable maximum sheet, and said conveyance path has a curved shape.

12. An image forming apparatus comprising:

an image forming portion which forms an image on a sheet; and a sheet processing apparatus which performs processing to the sheet or a sheet bundle on which the image is formed by said image forming portion, the sheet processing apparatus comprising:

a first folding unit which performs folding processing to a predetermined folding position on a sheet or a sheet bundle;

a second folding unit which folds the sheet or the sheet bundle folded by said first folding unit in an opposite direction to said first folding unit at said predetermined folding position; and a conveyance path connecting said first folding unit and said second folding unit, wherein a length of said conveyance path is shorter than a length from said predetermined folding position of a foldable sheet to an end portion of the foldable sheet in a conveyance direction, and said conveyance path has a curved shape.

13. An image forming apparatus comprising:

an image forming portion which forms an image on a sheet; and a sheet processing apparatus which performs processing to the sheet or a sheet bundle on which the image is formed by said image forming portion, the sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit processes the sheet one by one, said second folding unit folds the plurality of sheets folded by said first folding unit while superimposing the sheets on top of another, and said first folding unit includes a first folding roller pair which folds the sheet while conveying the sheet and a first pushing member which pushes the sheet one by one toward said first folding roller pair.

14. An image forming apparatus comprising:

an image forming portion which forms an image on a sheet; and a sheet processing apparatus which performs processing to the sheet or a sheet bundle on which the image is formed by said image forming portion, the sheet processing apparatus comprising:

a first folding unit which performs folding processing to a predetermined folding position on a sheet or a sheet bundle; and a second folding unit which folds the sheet or the sheet bundle folded by said first folding unit in an opposite direction to said first folding unit at said predetermined folding position, wherein said first folding unit processes the sheet one by one, said second folding unit folds the plurality of sheets folded by said first folding unit while superimposing the sheets on top of another, and said second folding unit includes a second folding roller pair which folds the sheet or the sheet bundle while conveying the sheet or the sheet bundle and a second pushing member which pushes the sheet or the sheet bundle toward said second folding roller pair in the opposite direction to said first folding roller pair at said predetermined folding position.

* * * * *